US012371891B2

(12) United States Patent
Vitarelli et al.

(10) Patent No.: US 12,371,891 B2
(45) Date of Patent: Jul. 29, 2025

(54) STORMWATER BOX WITH TRUSSES

(71) Applicant: Advanced Drainage Systems, Inc., Hilliard, OH (US)

(72) Inventors: Ronald Vitarelli, Marlborough, CT (US); Paul Holbrook, Old Saybrook, CT (US); Bryan Coppes, Old Saybrook, CT (US)

(73) Assignee: ADVANCED DRAINAGE SYSTEMS, INC., Hilliard, OH (US)

( * ) Notice: Subject to any disclaimer, the term of this patent is extended or adjusted under 35 U.S.C. 154(b) by 159 days.

(21) Appl. No.: 18/148,915

(22) Filed: Dec. 30, 2022

(65) Prior Publication Data

US 2023/0212848 A1 Jul. 6, 2023

Related U.S. Application Data

(60) Provisional application No. 63/295,486, filed on Dec. 30, 2021.

(51) Int. Cl.
*E03F 1/00* (2006.01)
*E03F 5/14* (2006.01)

(52) U.S. Cl.
CPC ..... *E03F 1/005* (2013.01); *E03F 5/14* (2013.01)

(58) Field of Classification Search
CPC ..... E03F 1/005; B65D 90/023; E02B 11/005
See application file for complete search history.

(56) References Cited

U.S. PATENT DOCUMENTS 6,632,046 B2 10/2003 King et al.
6,648,549 B1 * 11/2003 Urriola ..... E02B 11/005 210/170.03
6,962,464 B1 11/2005 Chen
7,591,610 B2 9/2009 Krichten et al.
7,704,011 B2 4/2010 Marshall
8,292,117 B2 10/2012 Guibert et al.
(Continued)

FOREIGN PATENT DOCUMENTS

AU 2012/373593 B2 8/2017
DE 20221567 U1 8/2006
(Continued)

OTHER PUBLICATIONS

International Search Report Written Opinion for PCT/US2022/082664, Dated May 8, 2023.

*Primary Examiner* — Benjamin F Fiorello
(74) *Attorney, Agent, or Firm* — Finnegan, Henderson, Farabow, Garrett & Dunner LLP

(57) ABSTRACT

Stormwater and fluid management runoff systems, apparatus, and methods for containing and filtering runoff may be provided. In one implementation, a stormwater management box for managing stormwater runoff may be provided. The stormwater management box may include a top plate and a base plate having a plurality of spaced apart columns positioned therebetween. The stormwater management box may include one or more side panels positioned between the top plate and the base plate, each side panel comprising a cover. The stormwater management box may also include a truss, the truss running perpendicular to the vertical plane of the one or more side panels and fitting within a vertical space between an upper surface of the bottom plate and a lower surface of the top plate.

18 Claims, 11 Drawing Sheets

(56) References Cited

U.S. PATENT DOCUMENTS

| | | | | |
|---|---|---|---|---|
| 8,555,586 | B2 | 10/2013 | Lowe et al. | |
| 8,657,695 | B2 | 2/2014 | Wilson et al. | |
| 8,852,009 | B2 | 10/2014 | Culleton et al. | |
| 9,169,630 | B2 | 10/2015 | Wichmann et al. | |
| 9,506,235 | B2 | 11/2016 | Adams et al. | |
| 9,708,806 | B2 | 7/2017 | Meincke | |
| 9,896,832 | B2 | 2/2018 | Graf | |
| 9,957,987 | B2 | 5/2018 | Wandkowski et al. | |
| 10,132,069 | B2 | 11/2018 | Van Der Scheer et al. | |
| 10,415,260 | B2 | 9/2019 | Gooden | |
| 10,718,122 | B2 | 7/2020 | Gooden | |
| 10,808,390 | B2 | 10/2020 | Van Der Scheer et al. | |
| 10,808,391 | B2 | 10/2020 | Scheer et al. | |
| 10,808,392 | B2 | 10/2020 | Bhatia et al. | |
| 11,008,766 | B2 | 5/2021 | Gooden | |
| 11,492,793 | B2 * | 11/2022 | Kulick, III | E03F 1/002 |
| 12,049,749 | B2 * | 7/2024 | Alexander | E02B 11/00 |
| 2005/0100401 | A1 * | 5/2005 | Urriola | E01C 11/226 404/2 |
| 2007/0181197 | A1 * | 8/2007 | Krichten | E03F 1/005 137/833 |
| 2007/0217866 | A1 * | 9/2007 | Oscar | E03F 1/005 405/36 |
| 2007/0227094 | A1 * | 10/2007 | Oscar | B65D 90/027 52/630 |
| 2010/0021236 | A1 * | 1/2010 | Kreikemeier | E03F 1/005 405/55 |
| 2014/0291221 | A1 * | 10/2014 | Adams | E03F 3/046 210/170.03 |
| 2020/0032500 | A1 | 1/2020 | Bhatia et al. | |
| 2020/0056361 | A1 | 2/2020 | Bhatia et al. | |
| 2021/0027049 | A1 | 1/2021 | Chandel et al. | |
| 2021/0079641 | A1 | 3/2021 | Van Der Scheer et al. | |
| 2021/0388581 | A1 | 12/2021 | Messerschmidt et al. | |
| 2022/0243447 | A1 * | 8/2022 | Alexander | E03F 5/101 |
| 2023/0056371 | A1 * | 2/2023 | Larach | E03B 11/14 |

FOREIGN PATENT DOCUMENTS

| | | | |
|---|---|---|---|
| DE | 2020/11110303 | U | 1/2015 |
| EP | 1260640 | B1 | 4/2006 |
| EP | 1416099 | B1 | 9/2008 |
| EP | 2385178 | A2 | 11/2011 |
| EP | 1469133 | B1 | 3/2014 |
| EP | 2870300 | B1 | 5/2015 |
| EP | 2896755 | A1 | 7/2015 |
| EP | 3165687 | B1 | 2/2020 |
| GB | 2518195 | B | 8/2017 |
| KR | 2012-0063942 | A | 6/2012 |
| KR | 10-1866751 | B1 | 6/2018 |
| WO | 2009-128117 | A1 | 10/2009 |
| WO | 2014/006137 | A1 | 1/2014 |
| WO | 2018/114038 | A1 | 6/2018 |
| WO | 2018/114039 | A1 | 6/2018 |
| WO | 2020/041829 | A1 | 3/2020 |
| WO | 2020/185252 | A1 | 9/2020 |
| WO | 2021/125962 | A2 | 6/2021 |

* cited by examiner

STORMWATER BOX WITH TRUSSES

CROSS-REFERENCE TO RELATED APPLICATIONS

This application is based on and claims benefit of priority of U.S. Provisional Patent Application No. 63/295,486, filed on Dec. 30, 2021. The content of the foregoing application is incorporated herein by reference in its entirety.

TECHNICAL FIELD

This disclosure relates generally to systems, apparatus, and methods for fluid runoff management. In particular, this disclosure relates to stormwater treatment and storage through the use of a plurality of box or crate structures arranged for the underground detention of stormwater.

BACKGROUND

In connection with large impervious areas such as parking lots, environmental regulations often require that stormwater be detained in a stormwater management system and thereafter be either gradually released to water bodies or allowed to percolate into the earth. In many areas, real estate is costly, so it is undesirable to devote real estate to provide ponds, swales, or other above-ground stormwater management systems for detention. Such known techniques also may present associated maintenance and safety issues. To overcome these problems, one or more cavities may be provided within the earth, often beneath a paved area, to which stormwater flows from catch basins, is detained, and is then gradually percolated or released. Such solutions minimize real estate costs and may minimize maintenance and safety issues associated with above-ground stormwater management systems.

One way of creating such an underground stormwater detention space is to bury prefabricated plastic or concrete hollow structures. Other solutions for underground stormwater management systems may be a stormwater "box" or "crate" system. In an embodiment of a stormwater box system, a pair of rectangular injection molded thermoplastic horizontal perforated plates are separated vertically by columns or other spacers and define a rectanguloid box structure. There may be more than two horizontal plates within a box. Multiple boxes may be installed in an abutting arrangement on a flat surface within an excavated cavity in the earth into an array. The array may be backfilled with crushed stone, gravel, or other course or fine aggregates. In some embodiments, a stormwater box may have a cube shape with a top plate and a bottom plate, both of which have a square shape. An array of buried stormwater boxes may bear the load of overlying backfill and/or vehicular loads or other live loads that traverse the surface of the backfill. To accommodate such loads, it may be desirable to have in a box multiple fairly closely spaced columns or other vertical supports. It is desirable for a box-structure to resist a tendency for the sides or vertical members of the boxes to tilt sideways or for the columns to become unstable or buckle under vertical loading.

Thus, solutions are needed to provide improved underground stormwater management systems. Such solutions may include structural components to increase strength of a traditional stormwater box array and reduce or eliminate a tendency of stormwater boxes or stormwater box arrays to deflect, deform, tilt, buckle, or otherwise become unstable under vertical loading. Such solutions may also include an array comprised of abutted and/or stacked stormwater boxes. Solutions may further include stormwater boxes that may have perforated vertical side panels on the box sides which face toward the edges of the excavation. When sand, gravel, or the like is backfilled around the sides of the array, retained stormwater from within the boxes may percolate through the perforations into the surrounding media. In some embodiments, lattice-like side panels may help prevent the backfill from intruding laterally into the interior of the boxes of the array. It may be desirable that the side panels do not deflect inwardly to the point of applying lateral pressure on the columns or otherwise impair the structural integrity of a stormwater box.

Consistent with achieving the foregoing aims, it is a persistent goal to minimize the weight (and thus the cost) of material embodied in the stormwater boxes, to economically fabricate the stormwater boxes, to configure the stormwater boxes for compactness for storage and shipment to the point of use, and to assemble and install the stormwater boxes economically at or near the point of use.

SUMMARY

The disclosed embodiments describe systems, methods, and devices for managing fluid runoff. These systems, methods, and devices may include use of a stormwater management box, or the use of a plurality of stormwater management boxes formed into a stormwater management box assembly. An embodiment of a stormwater management box may be to function well when buried underground and may be economical to make, ship and assemble. Another embodiment may provide a stormwater box side with resistance to deformation. Other embodiments may include a stormwater box with side panels that resist deformation.

A stormwater box embodiment may comprise a horizontal base plate and a vertically spaced apart top plate. The embodiment may further include one or more spaced apart columns that run vertically from the upper surface of the base plate to the under surface of the top plate. In one embodiment, there may be six columns, though more or fewer columns may be used. In an embodiment, there may be at least one side panel that comprises a lattice-like planar member, called here a cover, to keep stone and the like from entering the box. The cover may fit an exterior vertical-rectangular opening of a stormwater box and may span the vertical space between the base plate and the top plate. In an embodiment, there may be one or more trusses, engaged with the cover of the side panel, the two plates, or both the side panel and the two plates. Another embodiment may include first and second trusses. The first and second trusses may run perpendicularly from the cover of the side panel into the interior of the box. In an embodiment, the upper and lower edges of a truss may be mechanically engaged with the undersurface of the top plate and the upper surface of the base plate, respectively. A truss may be engaged with the top plate and/or base plate through the use of a slot or cleat on each of the top plate and/or base plate, wherein the slot or cleat are configured to mate with an edge member of a truss.

In an embodiment, one or more trusses may be hinged connected to the cover. In such an embodiment, a truss may lie parallel to the plane of the cover during storage and shipment and may then be pivoted to be perpendicular to the cover at the time of placement of the side panel. In such embodiments, a truss may extend only partially into an interior of the box.

In some embodiments, one or more trusses may be separable from the side panel and cover. In some embodiments, a box may not include a side panel and/or a cover. Instead, at or near the point of use, the upper and lower ends of each truss may engage with a top plate, a bottom plate, or both.

The foregoing and other objects, features and advantages of the present invention will become more apparent from the following description of preferred embodiments and accompanying drawings.

DETAILED DESCRIPTION

The present disclosure has some common features with the disclosure of commonly owned patent application Ser. No. 17/504,097 (the "'097 application"), filed Oct. 18, 2021 entitled "Stormwater system having multiple plates and one piece columns." Embodiments of the present disclosure may utilize other features described in the '097 application, which is hereby incorporated by reference.

Components of a stormwater box may be made by injection molding thermoplastics such as polyethylene, polypropylene, polyvinyl chloride, acrylonitrile butadiene styrene, or other thermoplastics. Some or all of the components, but particularly the trusses, may be made of higher strength plastic materials. When high strength is desired, glass fiber filled olefin plastic or other fiberglass-reinforced plastic may be used. Alternatively, composite or engineered plastic material may be used. In further alternative embodiments, components may be made of non-plastic materials; for example, metal alloys, ceramic materials, and cementitious materials may be used.

Figure 7:
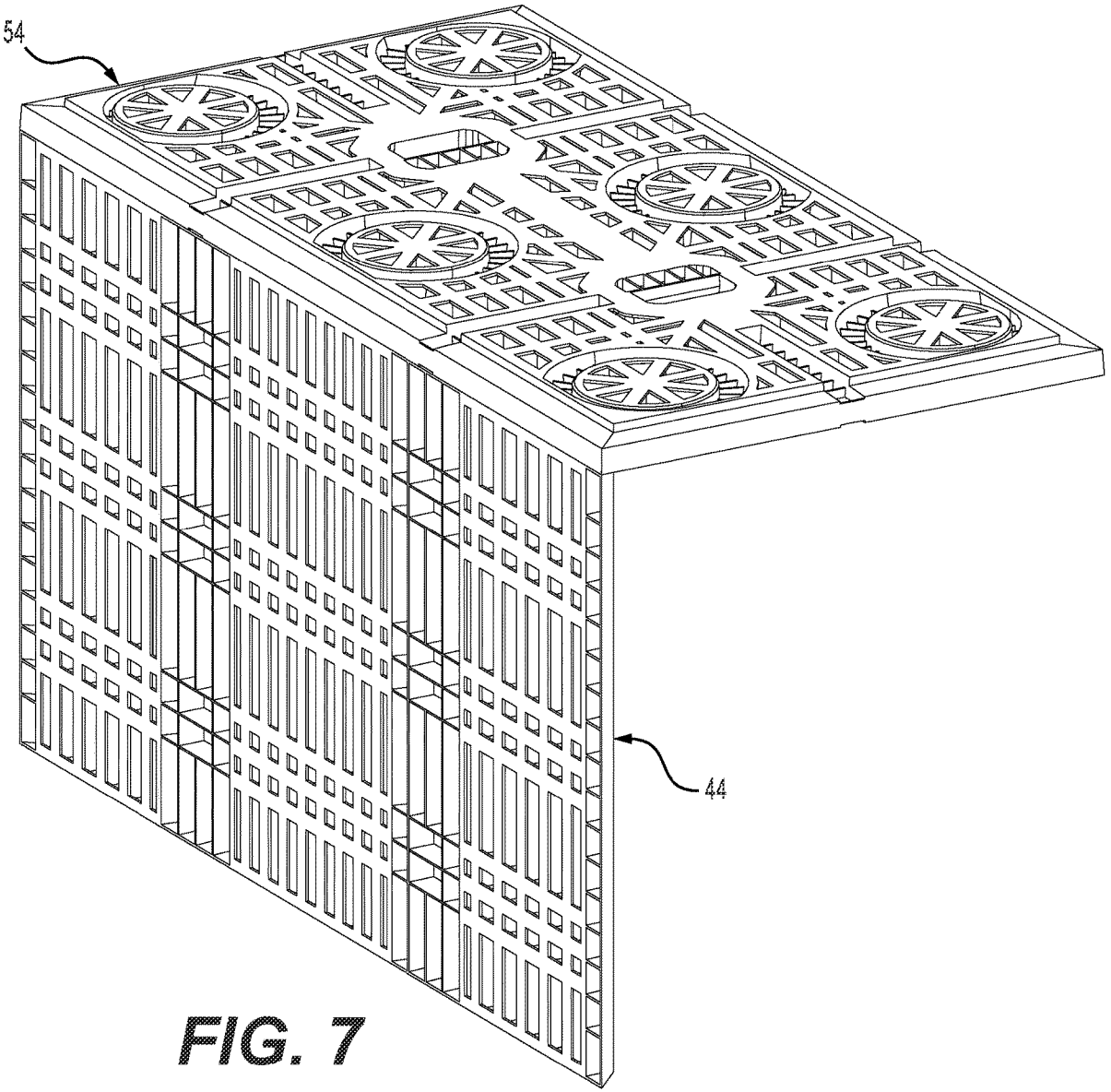
FIG. 7 illustrates a perspective view of an embodiment of the top plate and the cover of a stormwater box, consistent with embodiments of this disclosure.

In an embodiment of a stormwater box, the horizontal plates and the cover portion of the side panel may be configured to make economical use of material that enables water flow through the stormwater box. Each plate or panel embodiment may be formed with multiple closely spaced apart ribs and rib-defined openings, resulting in components that are strong but readily allow water passage through a lattice-like structure. FIG. 7 illustrates an example of a lattice-like ribbed construction. For simplicity of rendering, the lattice-like configuration is not reflected in most of the other Figures.

Figure 1:
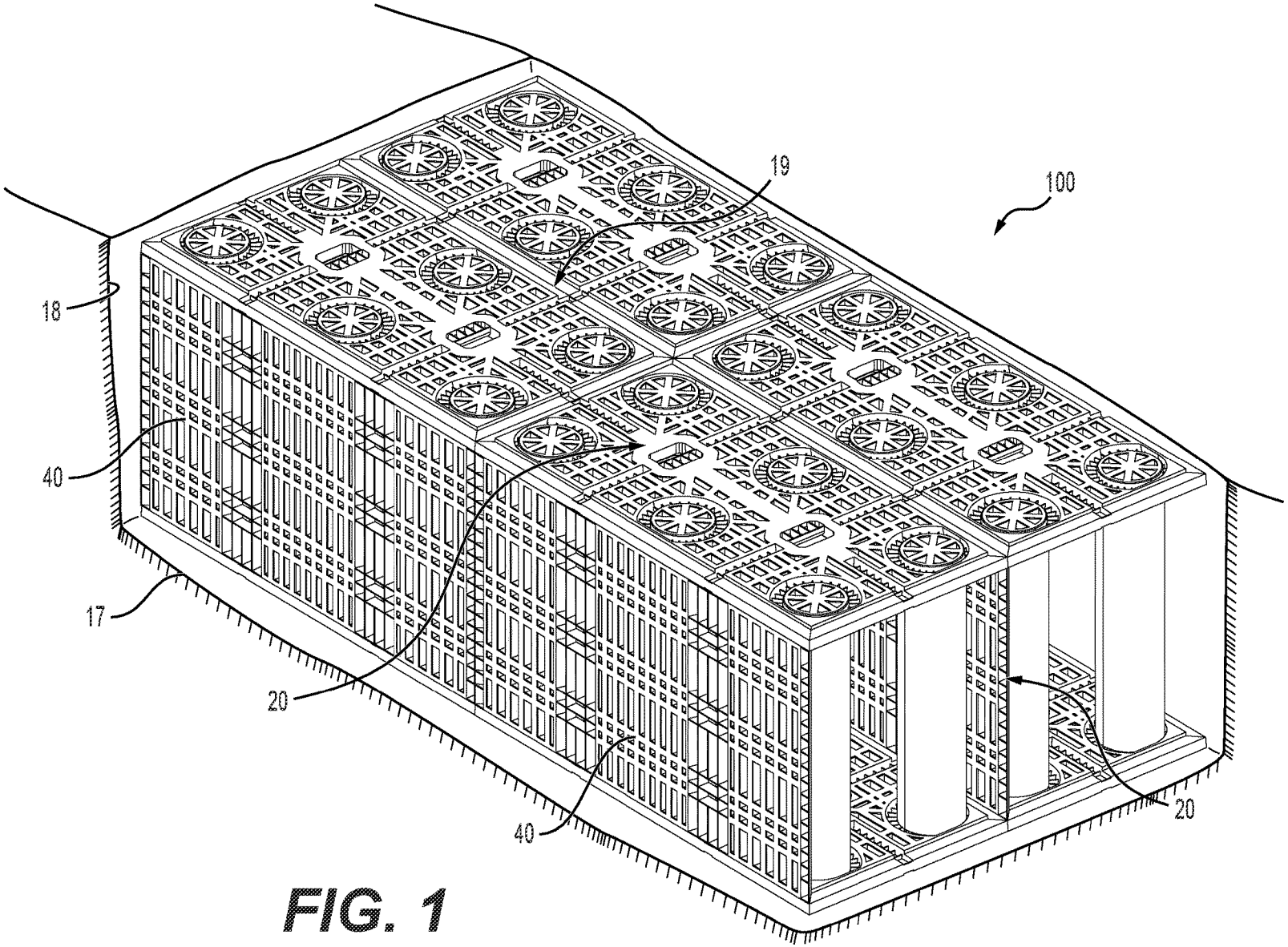
FIG. 1 illustrates a perspective view of an embodiment of an array of stormwater boxes located in an excavation, consistent with embodiments of this disclosure.
Figure 2:
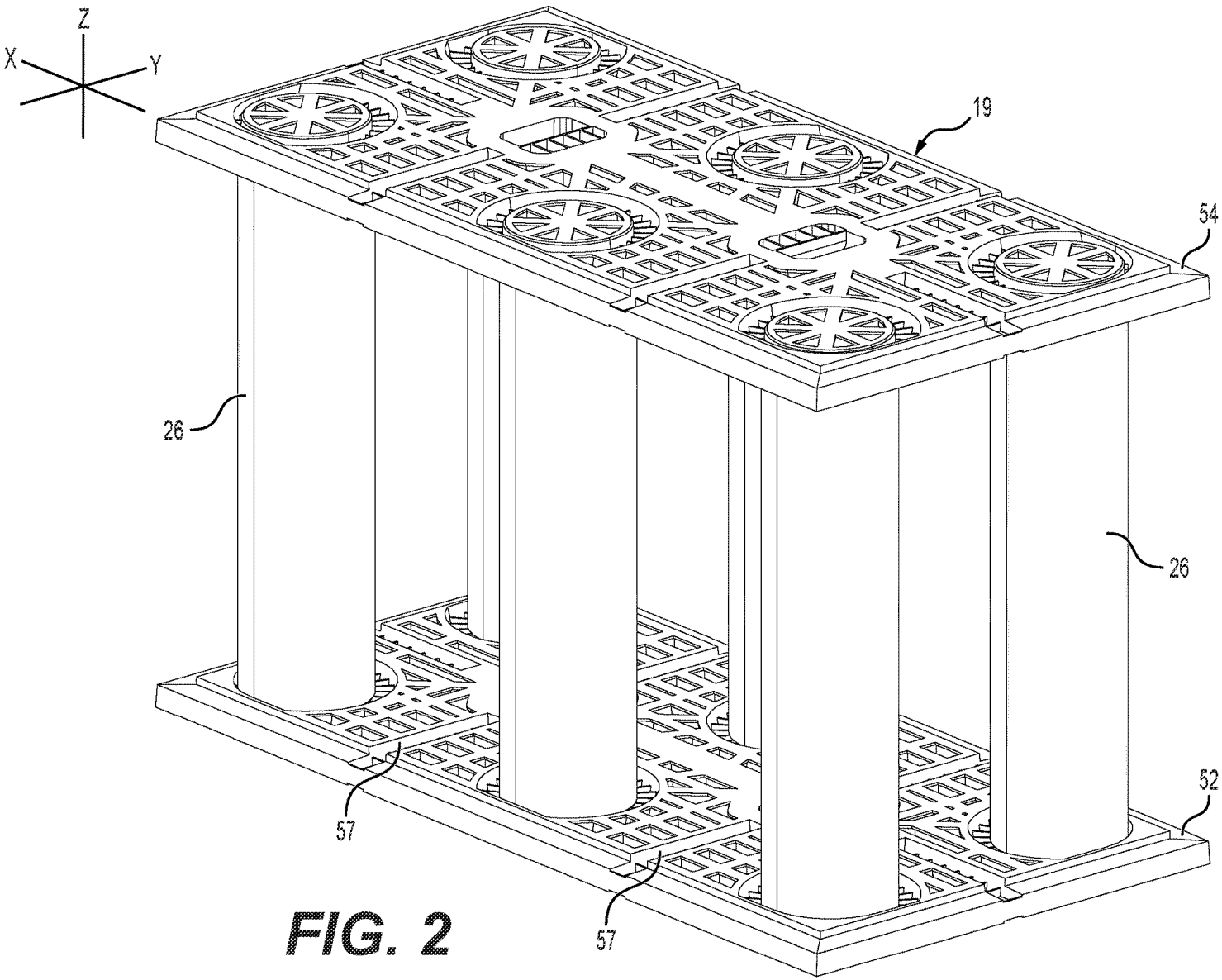
FIG. 2 illustrates a perspective view of an embodiment of a stormwater box.
Figure 3:
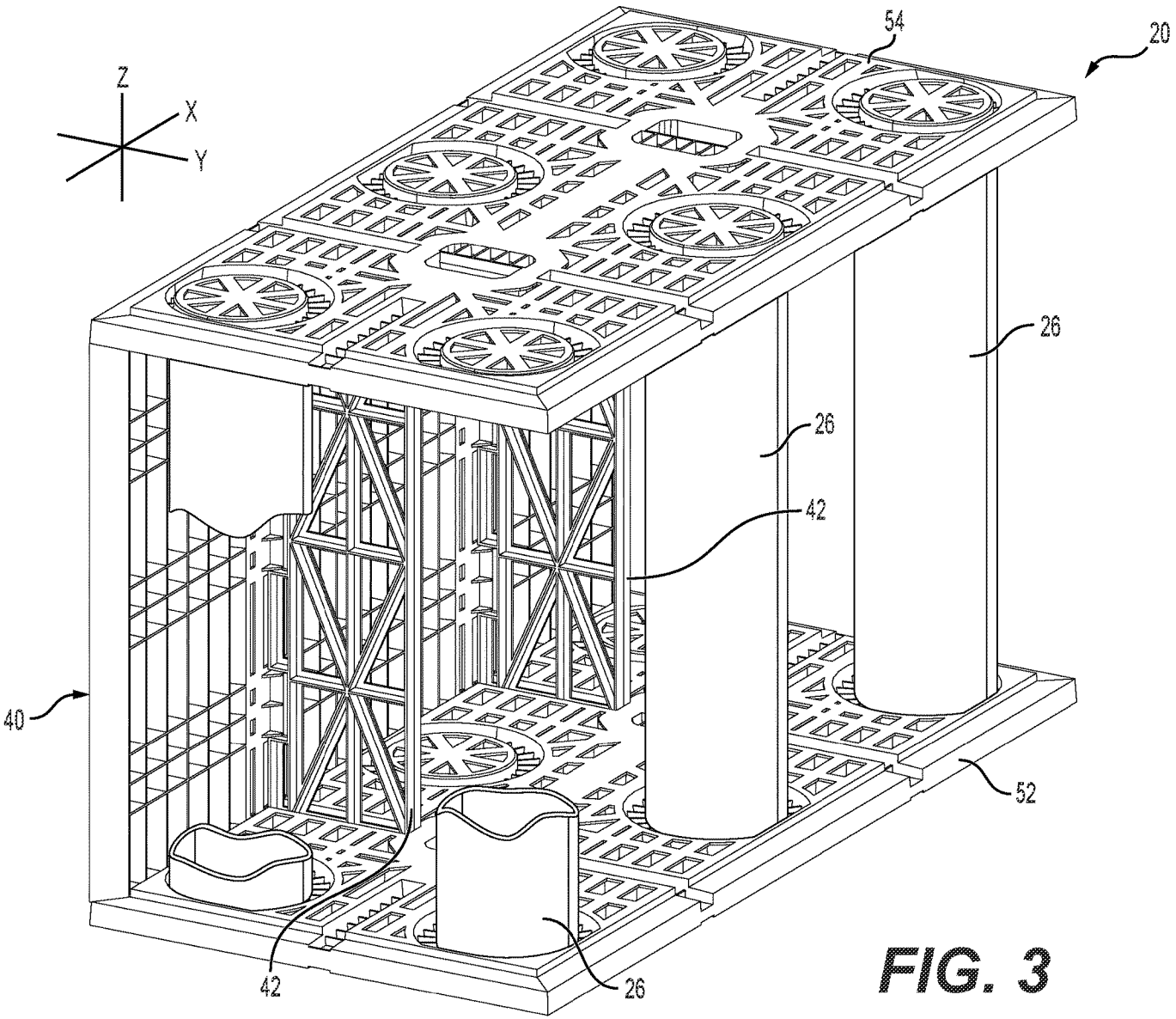
FIG. 3 illustrates a perspective view of an embodiment of a partially cut-away stormwater box with a side panel that comprises a cover and first and second trusses that are connected to the side panel, the top plate, and the base plate consistent with embodiments of this disclosure.

FIG. 1 shows an example of an array 100 for receiving stormwater. Array 100 is pictured deployed in an excavated cavity 18 within earth 17, ready for back-fill. Array 100 may include a plurality of abutting stormwater boxes 20 that may be stacked vertically, and as depicted in FIG. 1, may be stacked two-high, and will form a rectanguloid shape object. Array 100 is not limited to embodiments stacked two-high and may also include a single level of stormwater boxes or may include stacks more than two-high, such as three, four, five, or more levels. Examples of stormwater boxes 20 may be an assembly of elements including plate and pillar subassembly 19 as shown in FIG. 2. An example of box 20 may include one or more trusses 42 that extend from a side panel 40 as shown in FIG. 3. In an embodiment of array 100, stormwater boxes 20 which have a side panel 40 facing toward an edge of the excavation cavity 18 and thus will be contacted by backfill after installation. An interior plate and pillar subassembly 19 in an array 100 may have no side panels, and a stormwater box 20 positioned on a corner of an array where backfilled earth may touch two sides of the stormwater box 20 may have two side panels 40, one on a long end of the rectangular stormwater box 20 and one on a short end of the rectangular stormwater box 20.

FIG. 2 illustrates a perspective view of an embodiment of a plate and pillar subassembly 19, having x, y, and z axes. Plate and pillar subassembly 19 may include at least one side panel 40 to form a stormwater box 20 as shown in FIG. 3. Returning to FIG. 2, plate and pillar subassembly 19 may include two spaced apart horizontal plates: base plate 52 and top plate 54. In the embodiment depicted in FIG. 2, six columns 26 extend vertically upward from base plate 52 to top plate 54. In some embodiments, a stormwater box 20 may have more or fewer columns 26 and may have one or more other plates between the top plate 54 and the base plate 52. In an example of a plate and pillar subassembly 19, the lower end of each column 26 may be secured to base plate 52, and the upper end of each column 26 may be secured to the top plate 54 using "snap-lock" type fasteners for the columns, which are described in the '097 application incorporated herein by reference. Columns may also be secured to the base plate 52 and top plate 54 with fasteners, adhesives, and other connection mechanisms. Base plate 52 may also include grooves 57 for securing a side panel 40, which is further described below. Though not shown in FIG. 2, grooves 57 may also be located on the bottom side of top plate 54 and these grooves may correspond with the grooves 57 located on the top side of the base plate 52.

Turning to FIG. 3, in some embodiments, a stormwater box 20 may have at least one side panel 40 attached to a vertical side of the plate and pillar subassembly 19 of FIG. 2. In some embodiments, the at least one side of the stormwater box 20 with the attached side panel 40 will be that side of the box which is or will be exposed to soil or sand or crushed stone after the excavation cavity 18 is backfilled. An example of a side panel 40, shown in FIGS. 3, 4, 5 and 6, may include a cover 44 and two trusses 42 which are connected to the cover 44. In some embodiments, cover 44 may be perforated and flat. Furthermore, in some embodiments, the two trusses 42 may be hinge-connected to the side panel 40. When one or both trusses 42 are hinge-connected to a side panel 40, the side panel 40 may be assembled at a factory and economically shipped with the one or both trusses 42 folded parallel to the plane of the cover 44 of the side panel 40. FIG. 6 depicts a range of motion by depicting trusses 42 in a folded position 42P with dashed or phantom lines. At the point of assembly of the stormwater box 20, a folded truss 42P may be unfolded to be perpendicular to the cover 44 of the side plate 40. When a side panel 40 is in place, the trusses 42 may be mechanically attached to the top plate 54 and the base plate 52, and the cover portion 44 of the side panel 40 closes the rectangular vertical opening on a side of the stormwater box 20.

In some embodiments, plates and covers may be formed with a multiplicity of closely spaced ribs and associated small openings, thereby creating a lattice-like structure for the cover. Such a lattice-like structure results in a more economical use of materials compared to a solid structure and enables fluid to flow from inside of a stormwater box 20 to the exterior of the stormwater box 20 through the openings. FIG. 7 depicts a top plate 54 and a cover 44 according to an embodiment of the present disclosure. Embodiments of base plate 52 may be similar to top plate 54 depicted in FIG. 7 and may include comparable ribs and openings forming a lattice-like structure.

Figure 5:
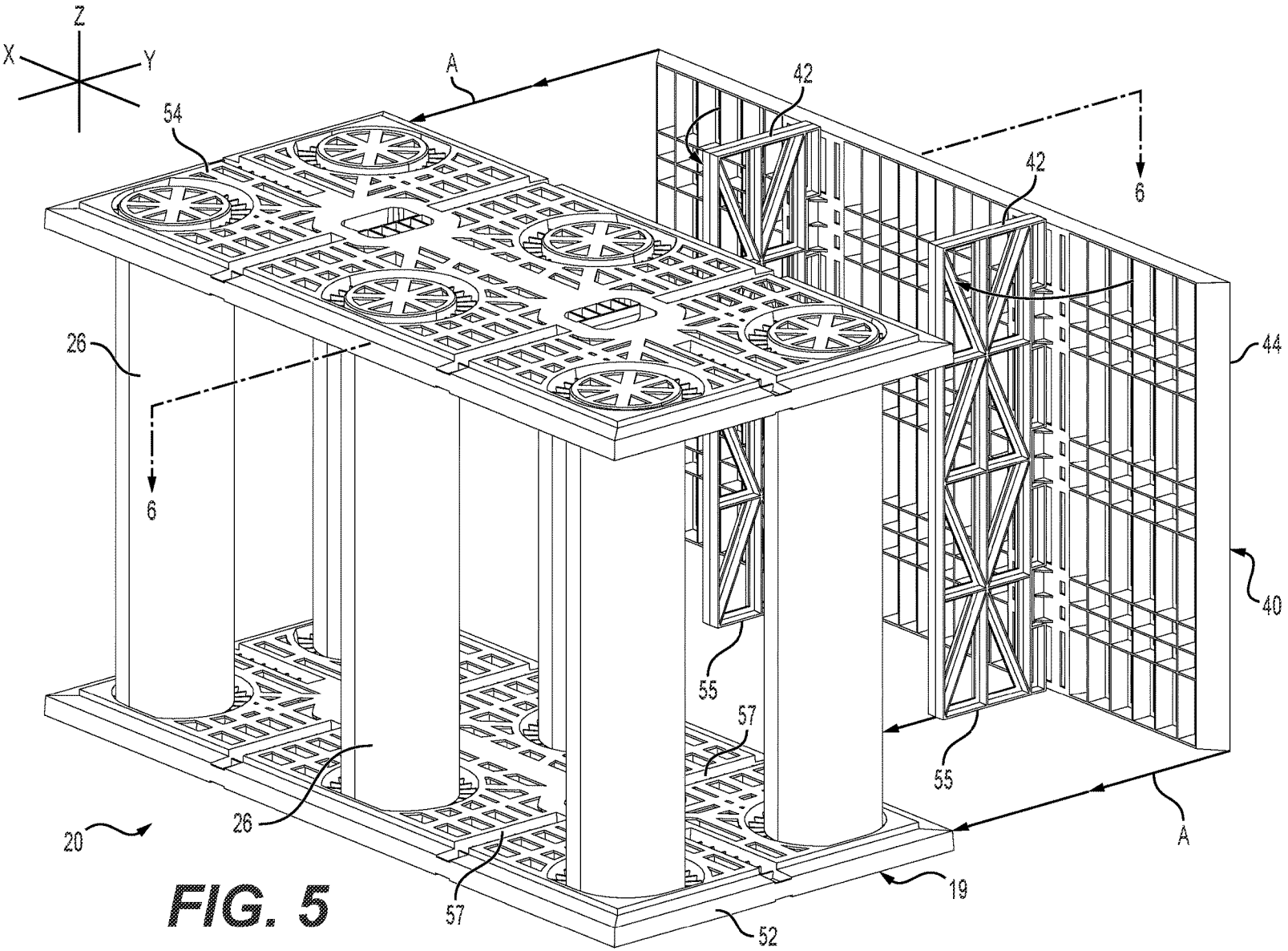
FIG. 5 illustrates an exploded perspective view of the stormwater box of FIG. 3, consistent with embodiments of this disclosure.
Figure 6:
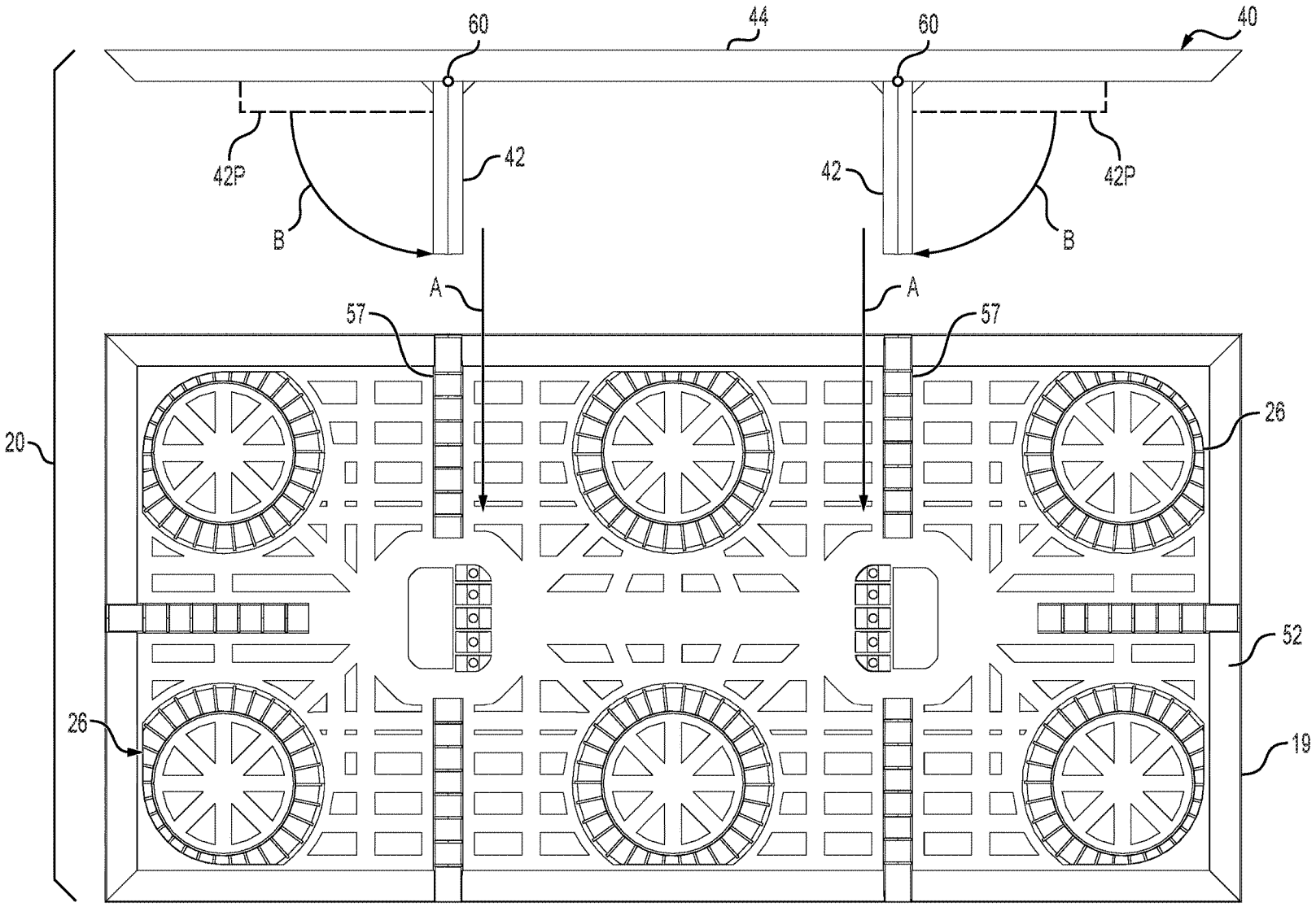
FIG. 6 illustrates an exploded top view of the stormwater box of FIG. 5, consistent with embodiments of this disclosure.

The exploded perspective view of an embodiment of stormwater box 20 in FIG. 5 shows side panel 40 as it is being installed in place, as indicated by the arrows A. The horizontal bottom strut 55 of each truss slides into a groove 57 in the upper surface of the base plate 52. The upper horizontal strut of each truss likewise slides into a groove (not visible) on the underside of the top plate 54.

In some embodiments, the rectangular cover 44 of a side panel 40 fits between the top plate 54 and the base plate 52, thereby imparting a resistance to change in dimension of the spacing of the plates between them, as might occur if the stormwater box 20 were to tilt or deform in the plane of the cover, because a shifting top plate 54 will contact the top side of the cover 44 and thus be stopped from further lateral movement. Optionally, there may be plastic snap fittings at different locations along the top and bottom edges of a cover 44 (not shown in FIG. 5), helping to keep the cover 44 securely within the opening between the bottom plate 52 and the top plate 54 of the stormwater box 20. Screws or other fasteners may alternatively be used to hold a cover 44 in place, when desired. Trusses 42 that are attached to the cover 44 may also hold the cover 44, and thus the panel 40, in place.

FIG. 6 illustrates a top view of the embodiment of stormwater box 20 shown in FIG. 5. As shown in FIG. 6, trusses 42 of side panel 40 may be hinge-connected to cover 44 of the side panel 40. Hinges 60 may be living hinges or mechanical hinges. The trusses 42 may lie flat in parallel with the cover 44, for shipping and storage, as indicated by phantom trusses 42P. As indicated in FIG. 6 by arrows B, each truss 42 may be rotated from the foregoing parallel position to a perpendicular-to-cover position when the side panel 40 is engaged with the pillar and plate subassembly 19.

An example of a truss of the present disclosure may extend across from about one-quarter to about one-third of the y axis width of a stormwater box 20 because that may be sufficient contact length for the purpose of securing the truss. The one-quarter to about one-third dimension used when there is a groove to receive the bottom member 55 of a truss 42, such as groove 57 in base plate 52 in the embodiment depicted in FIG. 5, mitigates any weakening of the strength of the base plate 52 due to the material lost by forming the groove on base plate 52 compared to a full-length groove across base plate 52. FIG. 5 depicts one example of groove 57 having a cross section s shaped like an upward-facing C. In some embodiments, the groove or slot 57 in the base plate 52, which receives the bottom strut 55 of truss 42, may be configured to "snap-fit" into the bottom most strut 55 of the truss 42.

Figure 10:
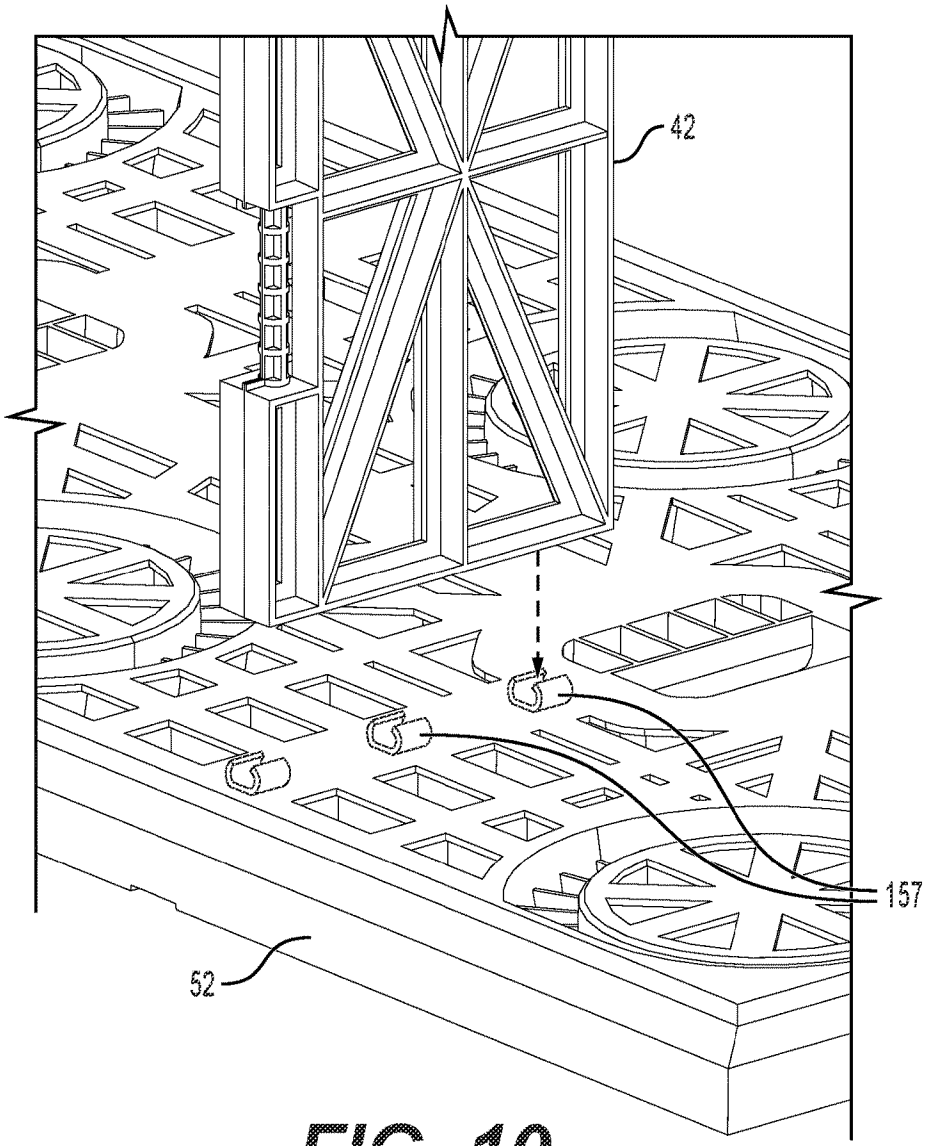
FIG. 10 illustrates an exploded view of a portion of an embodiment of a stormwater box showing the base plate and a truss, where the base plate top surface has multiple cleats to engage the lower edge of the truss, consistent with embodiments of this disclosure.

In some embodiments of side plate 40, not shown, one or both trusses 42 may extend perpendicularly from the cover 44 and are not movable. In some embodiments, not shown, trusses 42 may be separate elements and, at the time of assembly of a stormwater box 20, a vertical edge of a strut of a truss 42 may snap into place within grooves, cleats, or like fittings that run vertically on the flat interior surface of a cover. An embodiment depicting cleats 157 is shown in FIG. 10, discussed further below.

Figure 9:
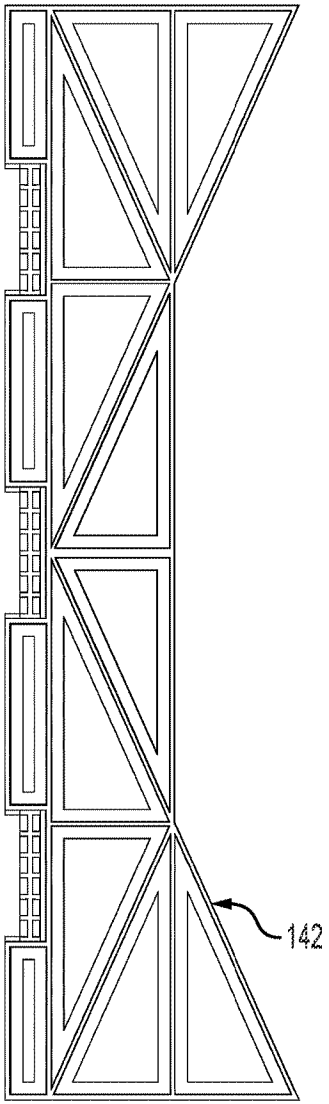
FIG. 9 illustrates a side elevation view of another truss consistent with embodiments of this disclosure.
Figure 8:
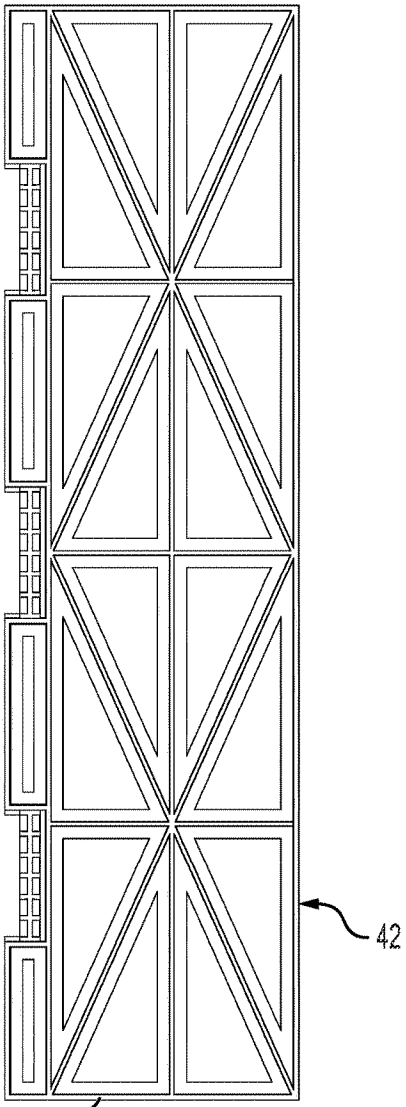
FIG. 8 illustrates a side elevation view of an embodiment of a truss, as shown in FIG. 3, consistent with embodiments of this disclosure.

Turning now to FIG. 8, which shows an embodiment of truss 42 having a plurality of struts that are interconnected for strength and rigidity to resist a lateral load that may be applied to the cover by soil, sand, stone, or other backfill with the benefit also of resisting tilting or deformation of the stormwater box 20 in the plane of the truss 42. FIG. 9 shows an alternative design of a truss 142 used in certain embodiments. Other configurations of trusses may be used in carrying out the invention.

A truss 42, 142 may be engaged or secured to the base plate and the top plate by means other than using a groove in the plate. For example, FIG. 10 shows a plurality of elastically upwardly facing C shape cleats 157 that are formed integral with the top surface of a base plate 52. Cleats 157 may be used to secure truss to a base plate 52 or top plate 54. The deflectable material cleats 157 shown in FIG. 10 may be shaped to receive the lower-end horizontal strut 55 of a truss 42 when the truss is pressed downwardly or is slid lengthwise. Other means of respectively securing the bottom edge and top edge of a truss to the top plate 54 and the base plate 52 may be employed.

Figure 4:
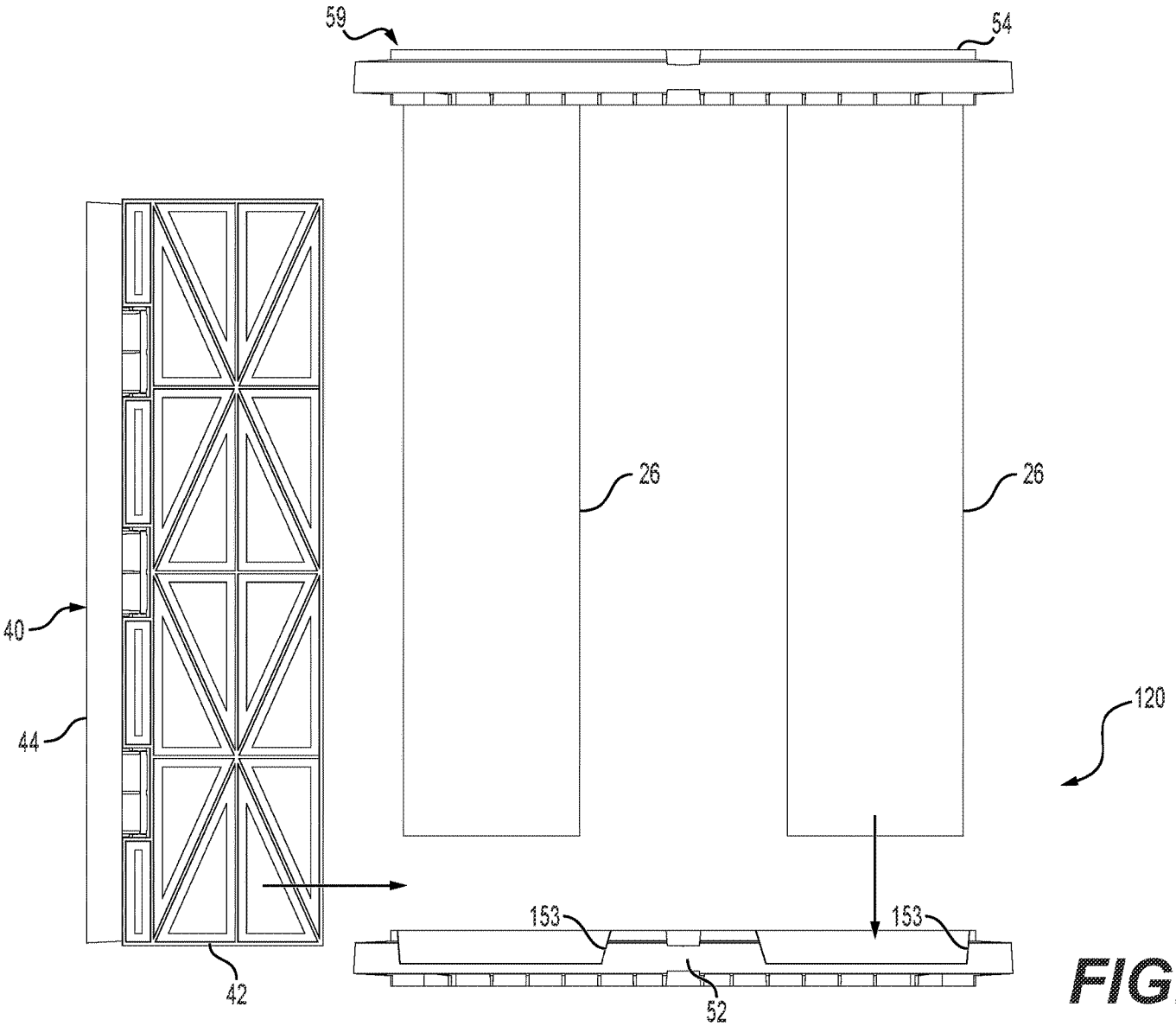
FIG. 4 illustrates an exploded side elevation view of the stormwater box of FIG. 3, consistent with embodiments of this disclosure.

In some embodiments, the columns 26 may be made integral with, or attached to, one of the top plate 54 or the base plate 52, at the point of manufacture. FIG. 4 shows an example of a stormwater box 120 where the upper ends of columns 26 are integral with, or permanently secured to, top plate 54, thus providing subassembly 59. To assemble a stormwater box 120, subassembly 59 is lowered onto the base plate 52, as indicated by the vertical arrow. The lower end of each column 26 may be received in a socket 153 on the upper surface of base plate 52 and may be secured to it by a snap-lock or other fastener. Side panel 40 may be inserted as shown by the horizontal arrow in FIG. 4. Alternatively, the base plate 52 rather than the top plate 54 may include attached or integral columns 26. An advantage of having columns 26 that are pre-attached to one plate is that it can save labor at the point of assembly of a stormwater box 20. In some embodiments, the upper surface of the top plate of an underlying box may serve also as the base plate for an overlying box.

Figure 11:
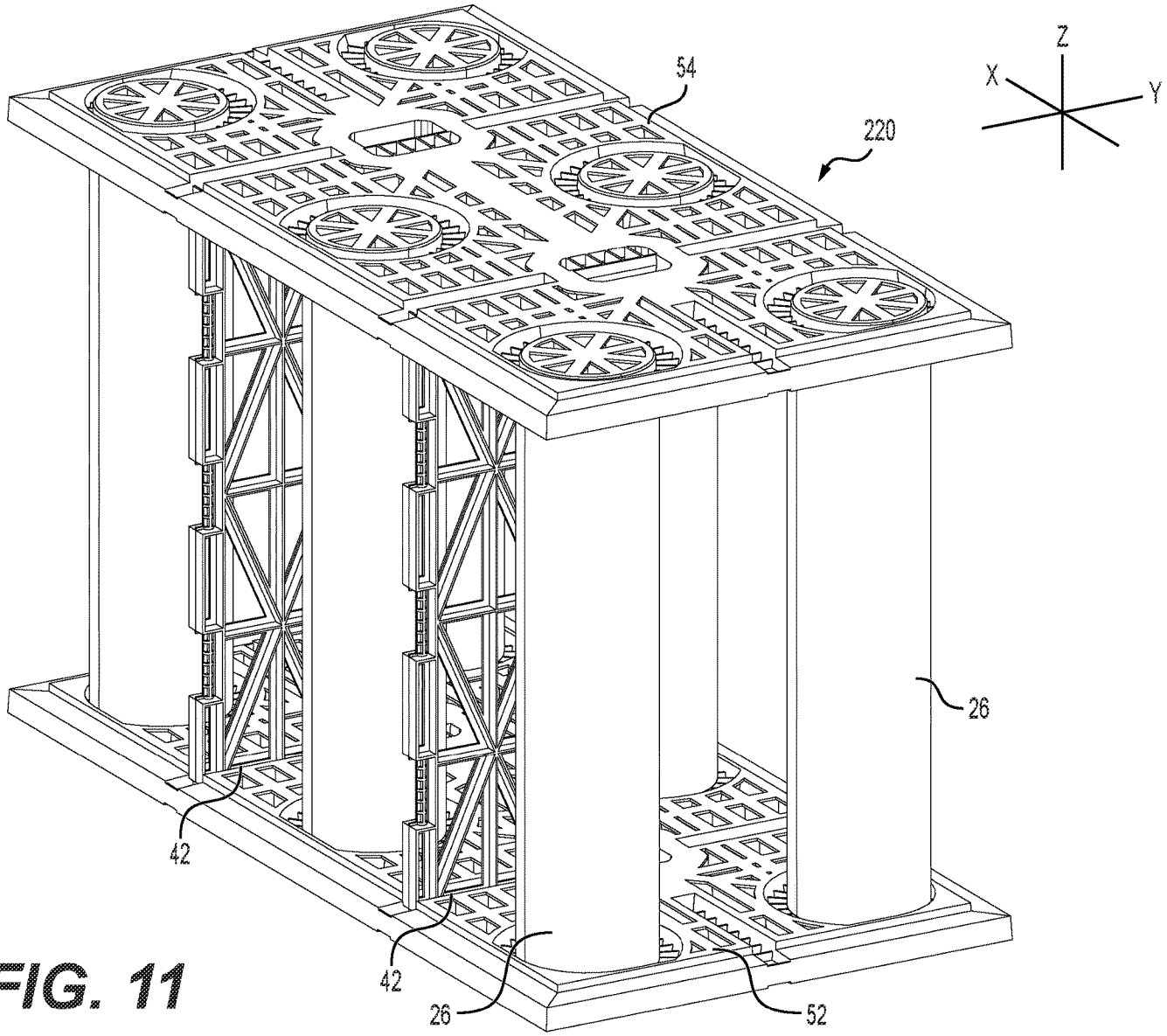
FIG. 11 illustrates a perspective view of an embodiment of a stormwater box with two trusses that run between the top plate and the base plate and partially across the width the box, consistent with embodiments of this disclosure.

FIG. 11 shows an embodiment of stormwater box 220 which includes base plate 52, top plate 54, columns 26, and trusses 42 that slide or snap into place between the two plates, consistent with embodiments described herein. Stormwater box 220 omits a side panel that comprises a cover. This embodiment may be used where there is no need for a cover, for example where the character of the backfill does not admit intrusion, or where intrusion of some backfill is not seen as a problem.

Trusses 42 may provide support for the side panels 40. Trusses 42 enable the use of side panel covers 44 that have lesser section modulus, and therefore lesser weight, than would be the case if the panel had to have comparable resistance to external load such as that applied by backfill adjacent to the box/assembly. Trusses 42 may also help a stormwater box 20 resist tilting or deformation in the plane of the trusses. And when the edges of the cover 44 of a side panel 40 fit closely between the top plate 54 and the bottom plate 52, or when the side panel 40 is secured to said plates, then the side panels can provide resistance to tilting or deformation in the plane of the sides to which the panels are affixed.

Side panels 40 comprising trusses 42 may be placed on each opposing side of a stormwater box 20, or on only some of the stormwater boxes 20 which comprise an array 100, depending on the need to resist media intrusion and the need for the structural strength that side panels having trusses provide. In some embodiments, a stormwater box may have side panels that lack the truss feature, i.e., the side panels will comprise a cover only. For example, in some embodiments, a cover without a truss may be screwed or otherwise attached to the side of a stormwater box. In some embodiments, a stormwater box may have no side panels, for example, stormwater boxes located entirely within an interior of an array. In some embodiments, all stormwater boxes at the periphery of an array may have side covers, preferably with trusses, to resist the lateral force of backfill around the periphery.

In some embodiments, side panels 40 may be secured to the smaller end opening of a stormwater box 20, i.e., the end of a rectanguloid stormwater box where two columns are presented in embodiments of the present disclosure such as in FIG. 11. A single truss may be hinged from the center of an end panel to provide the kind of support and simplified shipment which the side panels comprising trusses provide.

Figure 12:
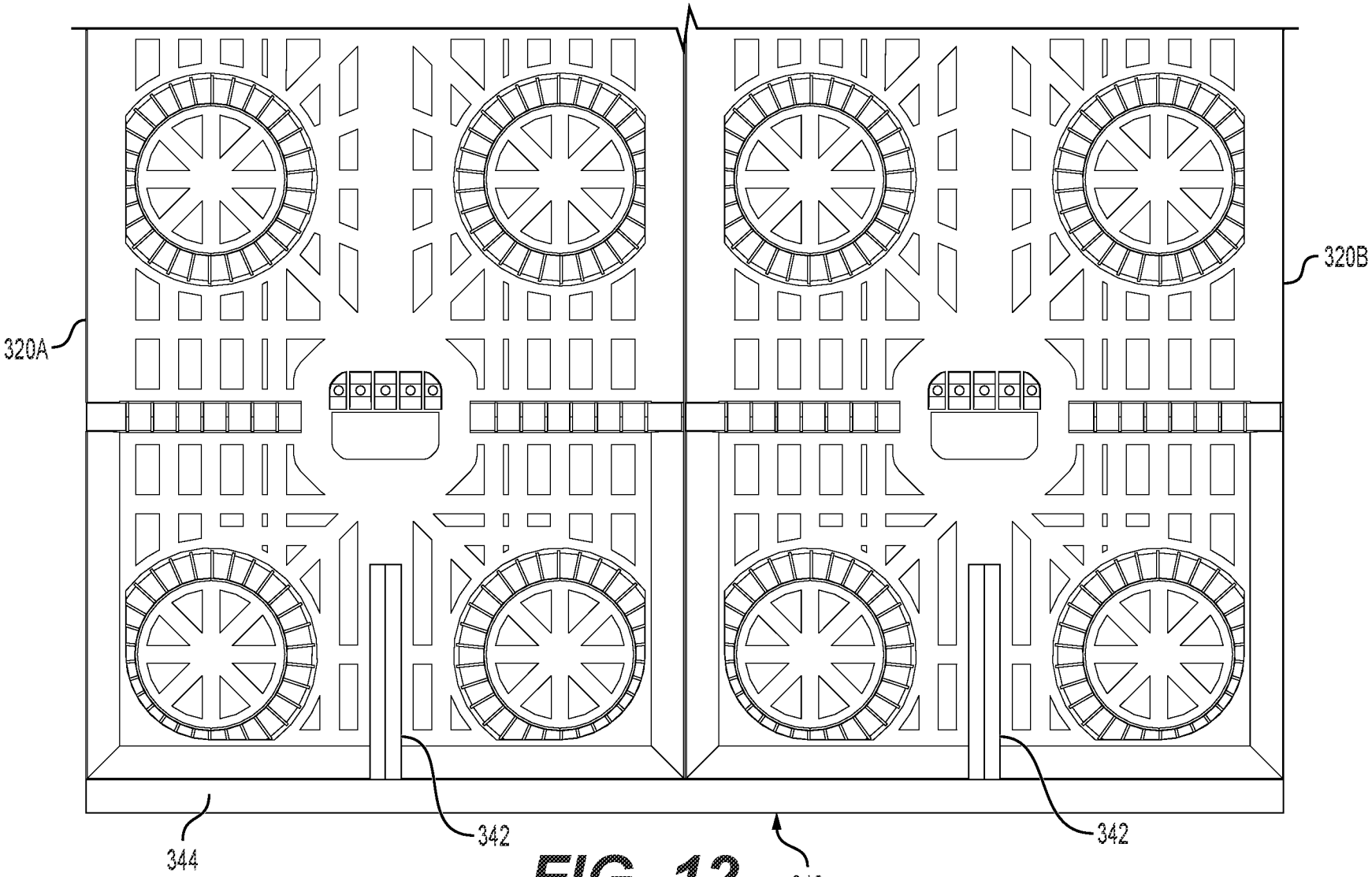
FIG. 12 illustrates a top view of an embodiment of two stormwater boxes with the top plate removed, showing a side plate with trusses engaged with the "small ends" of two adjacent boxes, consistent with embodiments of this disclosure.

The embodiment depicted in FIG. 12 shows two adjacent stormwater boxes 320A, 320B together with a side plate 340 that is mated with both the ends (i.e., the smaller dimension sides) of the rectanguloid boxes. Trusses 342 extend perpendicularly from the cover 344 of the side plate 340. Each truss 342 is engaged with the stormwater box into which it extends, in a way which has been described above for side plates engaged with the long end of a stormwater box.

Under the object of the present disclosure, stormwater boxes are economically fabricated and shipped. A truss that extends between horizontal plates of a columnar box may provide support and resistance against tilting or deforming of the stormwater box in the plane of the truss. A side panel that includes a cover configured to inhibit intrusion of surrounding backfill may be supported by one or more trusses. Trusses may be hingedly attached and may fold flat along the cover for compact and economical shipping and storage of side panels. Trusses that may snap in place with a fitting on the cover of a side panel at the point of use also may be economically shipped and stored.

Embodiments of the present disclosure may include:

A stormwater box comprising a top plate and a base plate spaced apart vertically, each of the top plate and the base plate having an upper surface and a lower surface; a plurality of spaced apart columns, each column being positioned vertically upward from the upper surface of the base plate to the lower surface of the top plate; and a first side panel having a cover and a first truss connected to the at least one side panel, the at least one side panel having a length and a height and lying in a vertical plane, wherein the at least one side panel is positioned between the top plate and the base plate and the at least one truss extends in a direction perpendicular to a vertical plane of the at least one side panel and is positioned between the upper surface of the bottom plate and the lower surface of the top plate. Other features of the stormwater box may include:

- wherein the first truss is pivotably connected to the cover of the first side panel and the first truss is movable from a first position to a second position;
- wherein in the first position the first truss is parallel to the plane of the cover, and in the second position the first truss is perpendicular to the plan of the cover;
- a second side panel;
- wherein the base plate further comprises at least one of a groove or a cleat on the upper surface of the base plate for engaging the lower end of the first truss;
- wherein the top plate further comprises at least one of a groove or a cleat on the lower surface of the top plate for engaging the upper end of the first truss;
- wherein the base plate further comprises a first groove or cleat on the upper surface of the base plate for engaging the lower end of the first truss connected to the first side panel; and
- a second groove or cleat on the upper surface of the base plate for engaging the lower end of the first truss connected to the second side panel;
- wherein the top plate further comprises a first groove or cleat on the lower surface of the top plate for engaging the upper end of the first truss connected to the first side panel; and
- a second groove or cleat on the lower surface of the top plate for engaging the upper end of the first truss connected to the second side panel;
- wherein the first truss extends between one quarter and one third of a distance across a length of the surface of the base plate;
- wherein the plurality of spaced apart columns are secured to one or more of the top plate or the base plate;
- wherein the cover comprises a plurality of spaced apart ribs forming a plurality of openings creating a lattice-like structure;
- wherein the first truss is formed of fiberglass-reinforced plastic;
- A stormwater box array may be formed having first and second stormwater boxes, wherein the first stormwater box adjoins the second stormwater box and at least one side panel is fitted within a vertical space between the top plate and the base plate of each of the first and second stormwater boxes.

Additional embodiments of the present disclosure may include:

A stormwater box comprising a top plate and a base plate spaced apart vertically, each of the top plate and bottom plate having an upper surface and a lower surface; a plurality of spaced apart columns, each column positioned vertically upward from the upper surface of the base plate to the lower surface of the top plate; a first side panel comprising a cover, the first side panel having a length and a height and lying in a vertical plane, the first side panel fitted within a vertical space between the top plate and the base plate; and a first truss, separable from the first side panel, the first truss running perpendicular to the vertical plane of the panel and fitting within a vertical space between the upper surface of the bottom plate and the lower surface of the top plate. Other features of the stormwater box may include:

a second side panel;

wherein the base plate further comprises at least one of a groove or a cleat on the upper surface of the base plate for engaging the lower end of the first truss;

wherein the top plate further comprises at least one of a groove or a cleat on the underside of the top plate for engaging the upper end of the first truss;

wherein the first truss extends between one quarter and one third of a distance across a length of the surface of the base plate;

wherein the plurality of spaced apart columns are secured to one or more of the top plate or the base plate;

wherein the cover comprises a plurality of spaced apart ribs forming a plurality of openings creating a lattice-like structure;

a stormwater box array may be formed having first and second stormwater boxes, wherein the first stormwater box adjoins the second stormwater box and the first side panel is fitted within the vertical space between the top plate and the base plate of each of the first and second stormwater boxes The disclosure, with explicit and implicit variations and advantages, has been described and illustrated with respect to several exemplary embodiments. Those embodiments should be considered illustrative and not restrictive possible examples and/or representations, and various changes, omissions and/or additions may be made, and, equivalents may be substituted for elements or exemplary embodiments. Unless specifically stated otherwise: any use of words such as "preferred" and variations suggest a feature or combination which is desirable but which is not necessarily mandatory, and, use of terms first, second, etc., do not denote order or importance. Thus, embodiments lacking any such preferred feature or combination may be within the scope of the claims which follow. Persons skilled in the art may make various changes in form and detail of the invention embodiments which are described, without departing from the spirit and scope of the claimed invention. Modifications and adaptations of the embodiments will be apparent from consideration of the specification and practice of the disclosed embodiments. For example, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents may be resorted to, falling within the scope of the disclosure.

What is claimed is:

1. A stormwater box comprising:

a top plate and a base plate spaced apart vertically, each of the top plate and the base plate having an upper surface and a lower surface;

a plurality of spaced apart columns, each column being positioned vertically upward from the upper surface of the base plate to the lower surface of the top plate; and a first side panel having a cover and a first truss connected to the at least one side panel, the at least one side panel having a length and a height and lying in a vertical plane, wherein the at least one side panel is positioned between the top plate and the base plate and is positioned between the upper surface of the bottom plate and the lower surface of the top plate;

wherein the first truss is pivotably connected to the cover of the first side panel and the first truss is movable from a first position to a second position; and wherein in the first position the first truss is parallel to the plane of the cover, and in the second position the first truss is perpendicular to the plane of the cover.

2. The stormwater box of claim 1, comprising a second side panel.

3. The stormwater box of claim 2, wherein the top plate further comprises:

a first groove or cleat on the lower surface of the top plate for engaging the upper end of the first truss connected to the first side panel; and a second groove or cleat on the lower surface of the top plate for engaging the upper end of the first truss connected to the second side panel.

4. The stormwater box of claim 1, wherein the base plate further comprises at least one of a groove or a cleat on the upper surface of the base plate for engaging the lower end of the first truss.

5. The stormwater box of claim 1, wherein the top plate further comprises at least one of a groove or a cleat on the lower surface of the top plate for engaging the upper end of the first truss.

6. The stormwater box of claim 1, wherein the base plate further comprises:

a first groove or cleat on the upper surface of the base plate for engaging the lower end of the first truss connected to the first side panel; and a second groove or cleat on the upper surface of the base plate for engaging the lower end of the first truss connected to the second side panel.

7. The stormwater box of claim 1, wherein the first truss extends between one quarter and one third of a distance across a length of the surface of the base plate.

8. The stormwater box of claim 1, wherein the plurality of spaced apart columns are secured to one or more of the top plate or the base plate.

9. The stormwater box of claim 1, wherein the cover comprises a plurality of spaced apart ribs forming a plurality of openings creating a lattice-like structure.

10. A stormwater box array comprising first and second stormwater boxes according to the stormwater box of claim 1, wherein the first and second stormwater boxes adjoin and at least one side panel is fitted within a vertical space between the top plate and the base plate of each of the first and second stormwater boxes.

11. A stormwater box comprising:

a top plate and a base plate spaced apart vertically, each of the top plate and bottom plate having an upper surface and a lower surface;

a plurality of spaced apart columns, each column positioned vertically upward from the upper surface of the base plate to the lower surface of the top plate;

a first side panel comprising a cover, the first side panel having a length and a height and lying in a vertical plane, the first side panel fitted within a vertical space between the top plate and the base plate; and a first truss, separable from the first side panel, the first truss fitting within a vertical space between the upper surface of the bottom plate and the lower surface of the top plate;

wherein the first truss is pivotably connected to the cover of the first side panel and the first truss is movable from a first position to a second position; and wherein in the first position the first truss is parallel to the plane of the cover, and in the second position the first truss is perpendicular to the plane of the cover.

12. The stormwater box of claim 11, comprising a second side panel.

13. The stormwater box of claim 11, wherein the base plate further comprises at least one of a groove or a cleat on the upper surface of the base plate for engaging the lower end of the first truss.

14. The stormwater box of claim 11, wherein the top plate further comprises at least one of a groove or a cleat on the underside of the top plate for engaging the upper end of the first truss.

15. The stormwater box of claim 11, wherein the first truss extends between one quarter and one third of a distance across a length of the surface of the base plate.

16. The stormwater box of claim 11, wherein the plurality of spaced apart columns are secured to one or more of the top plate or the base plate.

17. The stormwater box of claim 11, wherein the cover comprises a plurality of spaced apart ribs forming a plurality of openings creating a lattice-like structure.

18. A stormwater box array comprising first and second stormwater boxes according to the stormwater box of claim 11, wherein the first stormwater box adjoins the second stormwater box and the first side panel is fitted within the vertical space between the top plate and the base plate of each of the first and second stormwater boxes.

* * * * *